US005676286A

United States Patent [19]

Song

[11] Patent Number: 5,676,286

[45] Date of Patent: Oct. 14, 1997

[54] WHEELED KNAPSACK

[76] Inventor: Ann H. Song, 1 Palmatum, Irvine, Calif. 92720

[21] Appl. No.: 653,678

[22] Filed: May 24, 1996

[51] Int. Cl.[6] ..... A45C 13/26

[52] U.S. Cl. ..... 224/153; 190/18 A

[58] Field of Search ..... 224/153, 155; 190/18 A, 15.1

[56] References Cited

U.S. PATENT DOCUMENTS

| | | | |
|---|---|---|---|
| 2,375,338 | 5/1945 | Alexander | 190/18 A |
| 2,401,986 | 6/1946 | Talbott | 224/153 X |
| 3,653,474 | 4/1972 | Sadow | 190/18 A |
| 3,948,365 | 4/1976 | Gregg | 190/18 A |
| 4,030,768 | 6/1977 | Lugash | 280/47.17 |
| 4,406,353 | 9/1983 | Walker | 190/18 A |
| 4,747,526 | 5/1988 | Launes | 224/155 |
| 5,022,574 | 6/1991 | Cesari | 224/153 |
| 5,109,961 | 5/1992 | Bergman | 190/18 A |
| 5,156,310 | 10/1992 | Biedenharn | 224/155 |
| 5,209,328 | 5/1993 | Kotkins | 190/18 A |
| 5,255,834 | 10/1993 | Bendersky . | |
| 5,409,152 | 4/1995 | Trevino | 224/153 |
| 5,456,342 | 10/1995 | Rekuc | 190/18 A |

FOREIGN PATENT DOCUMENTS

| | | | |
|---|---|---|---|
| 2441358 | 7/1980 | France | 190/18 A |
| 120005 | 1/1950 | Germany | 224/153 |

*Primary Examiner*—Renee S. Luebke

*Attorney, Agent, or Firm*—James Y. Song

[57] ABSTRACT

A wheeled knapsack has at least two wheels attached to the base section along the rear edge of the bag portion. The wheels are attached away from the body-contact side of the bag portion such that the wheels avoid any possible contact with any part of the knapsack user's body, when the wheeled knapsack is carried on the user's back. By grabbing and pulling a handle attached to the non-body-contact side of the bag portion, the wheeled knapsack can be pulled on the ground in an inclined position without the shoulder straps touching or dragging on the surface of the ground. In another embodiment of the invention, a wheel assembly panel is mounted to the base section of the knapsack, and at least two wheels are attached to the wheel assembly panel. In an another embodiment, the wheeled knapsack has an axle passage that accommodates an axle with a wheel attached to each end of the axle.

10 Claims, 4 Drawing Sheets

WHEELED KNAPSACK

BACKGROUND OF THE INVENTION

1. Field of the Invention

This invention relates to a knapsack or a back pack which is carried on the back of a user by being suspended from the shoulders of a user, and particularly a knapsack or a back pack of the type which has wheels and can be pulled on a flat surface.

2. Description of the Related and Prior Arts

It has become very common to provide a suitcase, a luggage, a travel bag, or a garment bag with wheels so that it can be pulled along the ground or on the walkways. However, a knapsack with wheels that can be conveniently pulled in an inclined position has not been invented, yet. In general, a knapsack has a pair of shoulder straps by which the bag is suspended from the user's back so as to be carried on the user's back. Although the knapsack is often used by the hikers, the mountain climbers, and the campers who need to carry items on their back while needing two free hands to keep balance or to carry other items, the knapsack has become a favorite means among the students to carry school books, school supplies, and stationery. A knapsack, when containing text books, binders, and other school supplies, can become quite heavy. Although the knapsack in that condition is still easier to carry than a hand-carried bag with the similar load, the weight of the knapsack on the user's back, neck and shoulders is substantial, especially on the younger users.

SUMMARY OF THE INVENTION

The object of the present invention is to give to a knapsack user a choice of pulling the knapsack on the ground or on the walkways, where a flat surface is provided. Pulling a heavily loaded knapsack alleviates pressure on the user's back, neck, and shoulders.

The object is achieved by attaching at least two wheels along the rear edge of the base section of a knapsack. Attaching the wheels away from the body-contact side of the knapsack accomplishes two important functions: firstly, the wheels do not touch the user's back when the knapsack is carried on the user's back, and secondly, the shoulder straps do not come in contact with the ground, when the wheeled knapsack is pulled on the ground.

In another embodiment of the invention, a wheel assembly panel is mounted to the base section of the knapsack, and at least two wheels are attached to the wheel assembly panel. The wheel assembly panel is made from a rigid and durable material such as hard rubber. The areas of the knapsack near the wheels are more likely to come in contact with the surface of the ground, especially when the surface is uneven or has bumps. For that reason, the rigid wheel assembly panel can insulate the rest of the knapsack from being scratched or rubbed against such bumps on the surface. The wheel assembly panel also provides a better support for the wheels.

In another embodiment of the invention, the wheeled knapsack can accomodate an axle through an axle passage. An axle, which is slightly longer than the width of the knapsack, is placed in the axle passage, with a wheel attached to each end of the axle. As the knapsack is pulled, the axle and the wheels turn, causing the knapsack to move on the flat surface of the ground.

DETAILED DESCRIPTION OF THE INVENTION

Figure 1:
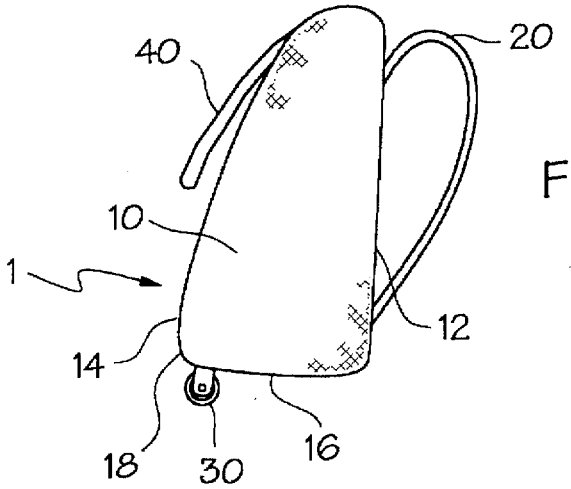
FIG. 1 is a side elevational view of a wheeled knapsack according to the first preferred embodiment.
Figure 2:
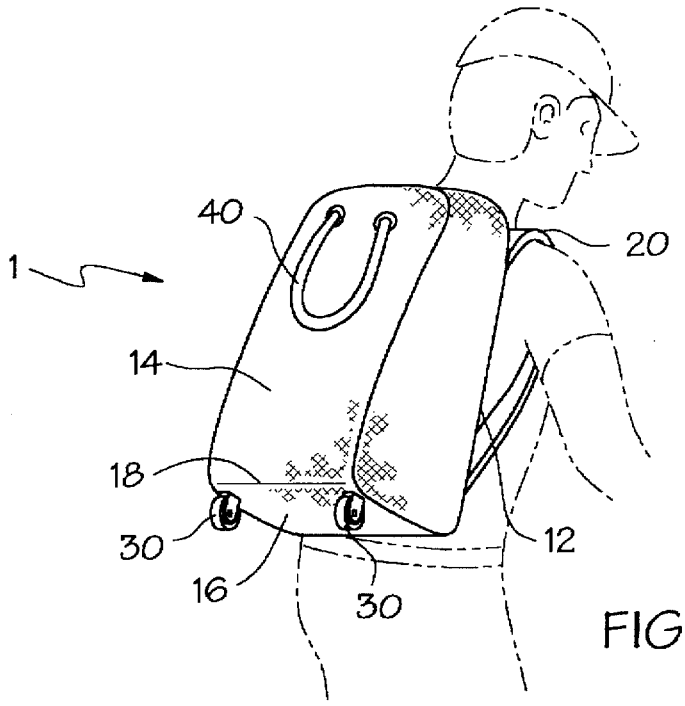
FIG. 2 is a perspective view of the first preferred embodiment of a wheeled knapsack as it is carried on a user's back.

FIG. 1 shows a preferred embodiment of a wheeled knapsack. The wheeled knapsack 1 has a bag portion 10 which is usually made of a woven or non-woven fabric of natural or synthetic fibers so as to have suitable levels of flexibility and rigidity. The bag portion 10 has a body-contact side 12, a non-body-contact side 14, and a base section 16. A pair of shoulder straps 20 is attached to the body-contact side 12 of the bag portion 10. The base section 16 can be made from the same material as the bag portion, or from a more durable material such as leather, synthetic leather, or flexible rubber. A wheeled knapsack 1 has at least two castered wheels 30 attached to the base section 16 away from the body-contact side 12 of the bag portion 10. As shown in FIG. 1 and FIG. 2 of this preferred embodiment of the invention, a pair of castered wheels 30 is attached longitudinally along a rear edge 18, which is formed by the non-body-contact side 14 and the base section 16. The castered wheels 30 should be spaced in the sideways direction apart from each other, and the distance between two outermost castered wheels 30 should be approximately the width of the rear edge 18. In the event that more than two castered wheels are attached, they should also be positioned along the rear edge 18, spaced in the sideways direction apart from each other. With the castered wheels 30 attached along the rear edge 18 away from the body-contact side 12, they do not come in contact with the back of the user even when the wheeled knapsack is placed on the user's back.

Figure 3:
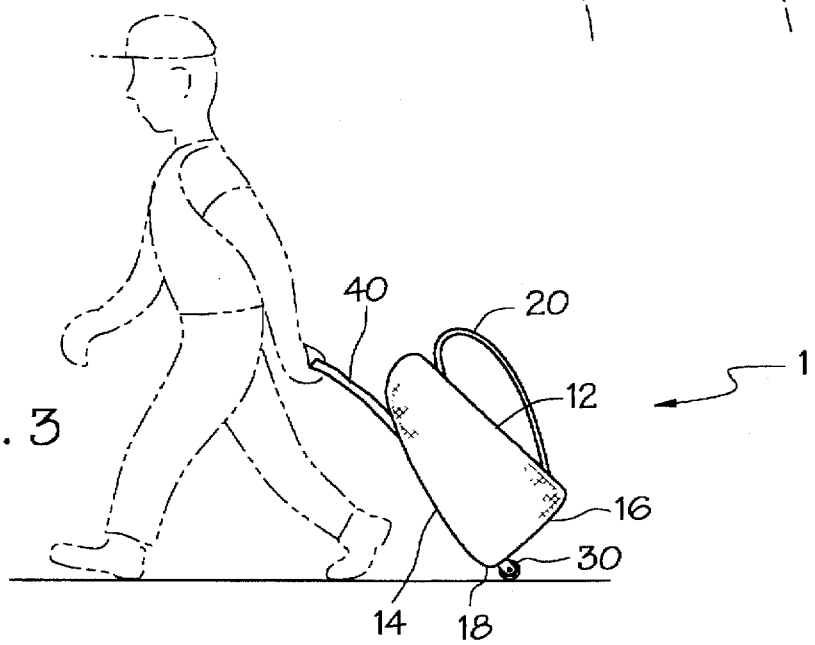
FIG. 3 is a side elevational view of the first embodiment of a wheeled knapsack as it is being pulled by a user on a flat surface.

A pulling means 40 can be either a conventional U-shaped handle or a strap, and is attached near the top of the bag portion 10. In the preferred embodiment, the pulling means 40 is a U-shaped strap handle that is attached on the non-body-contact side 14 near the top of the bag portion 10, as shown in FIG. 1 and FIG. 2. When the user grabs the pulling means 40 and pulls the wheeled knapsack 1, the wheeled knapsack tilts slightly toward the direction from which it is being pulled, as shown in FIG. 3. Since the shoulder straps 20 are attached to the body-contact side 12 of the bag portion 10, the shoulder straps 20 face upward as the wheeled knapsack is pulled by the user, as shown in FIG. 3. As a result, the shoulder straps 20 will not touch the ground as the wheeled knapsack is pulled on the surface of the ground or the walkways.

Figure 4:
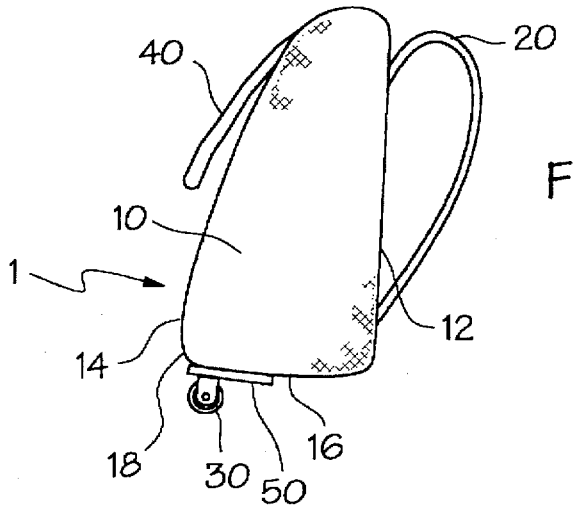
FIG. 4 is a side elevational view of a wheeled knapsack according to the second preferred embodiment.
Figure 5:
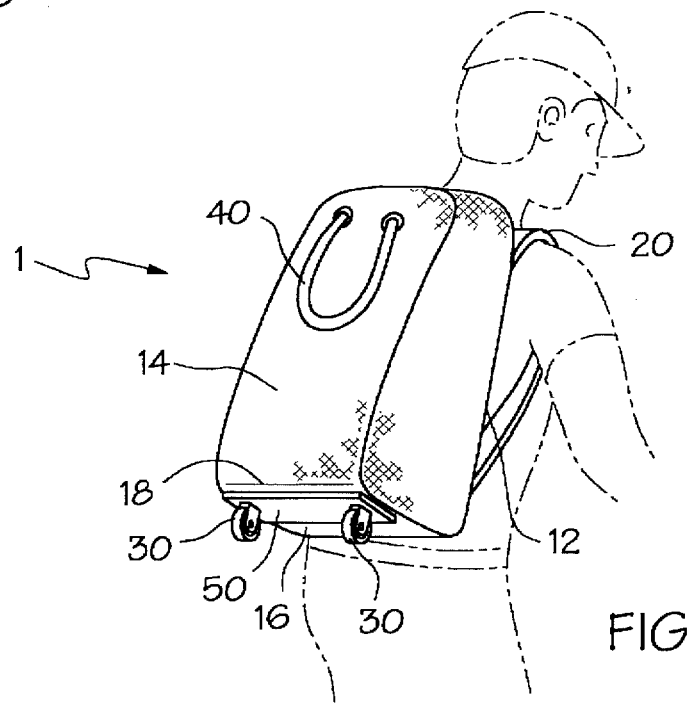
FIG. 5 is a perspective view of the second preferred embodiment of a wheeled knapsack as it is carried on a user's back.
Figure 6:
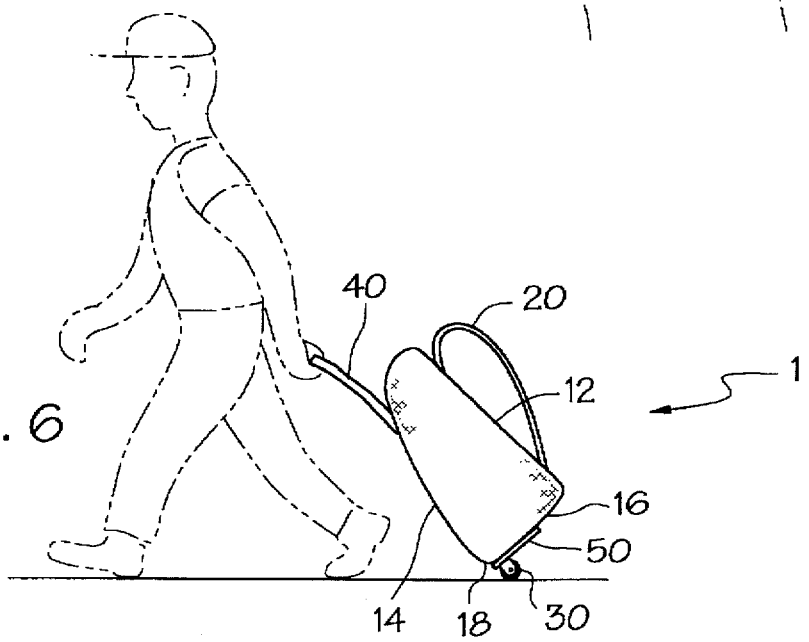
FIG. 6 is a side elevational view of the second embodiment of a wheeled knapsack as it is being pulled by a user on a flat surface.

FIG. 4 and FIG. 5 show a second preferred embodiment of the invention. In this embodiment, a wheel assembly panel 50 is longitudinally mounted to the base section 16 of the bag portion 10 near the rear edge 18. At least two castered wheels 30 are attached to a wheel assembly panel 50 in the sideways direction, with the castered wheels 30 positioned apart from each other. FIG. 5 shows two castered wheels 30 attached to the wheel assembly panel 50. More wheels can be attached in a similar fashion. The length of the wheel assembly panel 50 is approximately the width of the bag portion 10. The wheel assembly panel is made from a hard rubber, or other suitable synthetic material that provides rigidity and durability. The wheel assembly panel 50 protects the base section 16 from prematurely wearing out from occasional friction with the uneven surface on the ground. Thus, the wheeled knapsack having the wheel assembly panel is particularly suitable for heavy duty usage.

Figure 7:
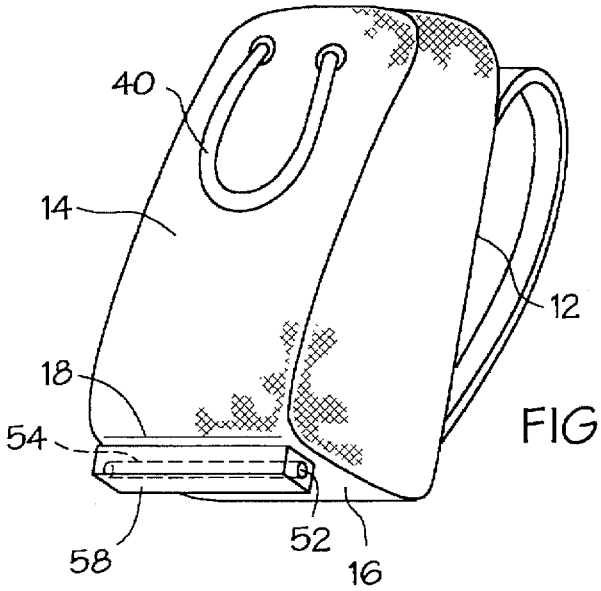
FIG. 7 is a perspective view of the third preferred embodiment, showing a wheel axle panel without an axle.
Figure 8:
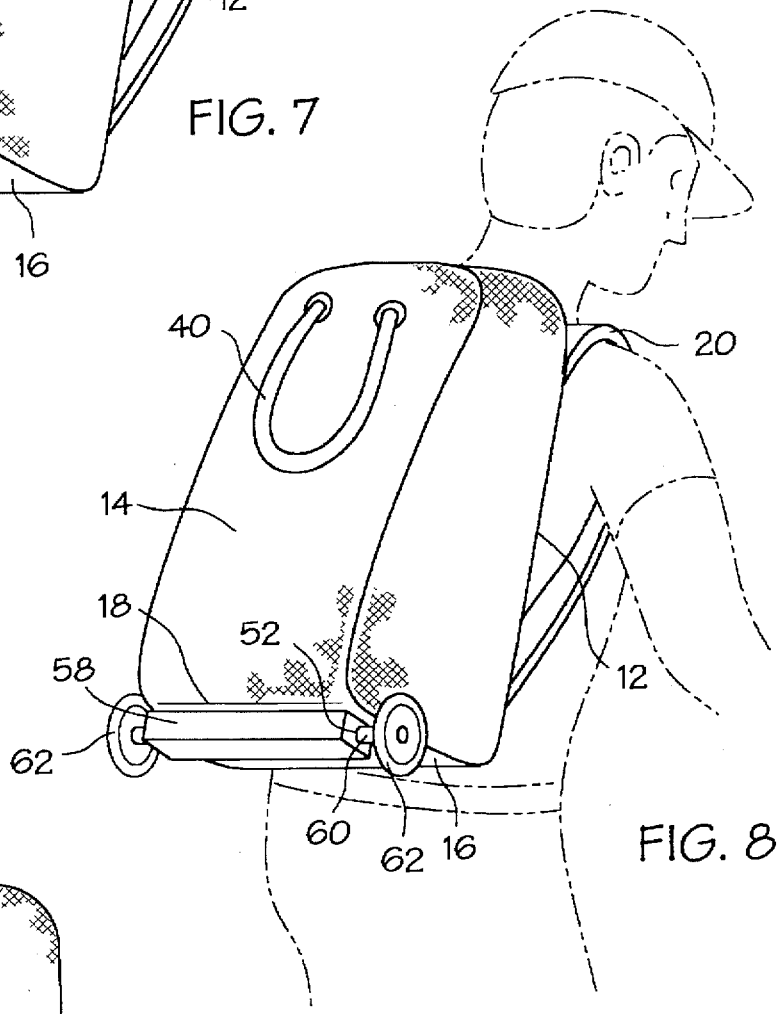
FIG. 8 is a perspective view of the third preferred embodiment of a wheeled knapsack as it is being carried on a user's back.
Figure 9:
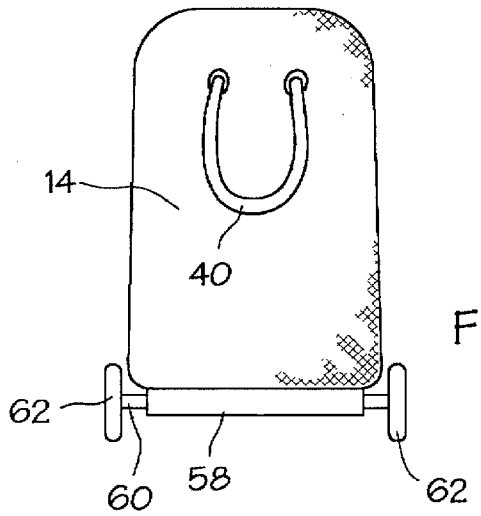
FIG. 9 is a rear elevational view of the third preferred embodiment of a wheeled knapsack.

FIG. 7, 8, and 9 show the third preferred embodiment of the invention. In this embodiment a wheel axle panel 58 is longitudinally mounted to the base section 16 of the bag portion 10 near the rear edge 18. However, in this embodiment, the wheel axle panel 58 includes an axle passage 52. The axle passage 52 is formed by a longitudinal bore 54 extending through and within the wheel axle panel 58, as shown in FIG. 7. An axle 60, which is slightly longer than the width of the bag portion 10, is placed within the axle passage 52 through the longitudinal bore 54. Each of two axle wheels 62 is attached to each end of the axle 60, supporting the wheeled knapsack 1, but not in contact with the bag portion 10, as shown in FIG. 9.

Figure 10:
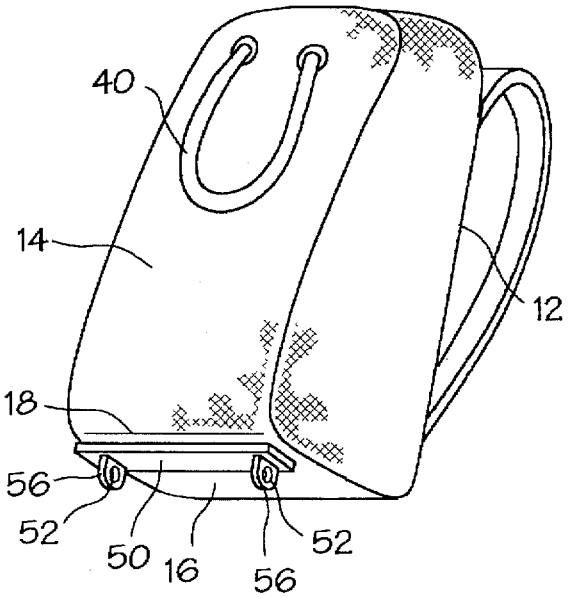
FIG. 10 is a perspective view of another preferred embodiment, having an axle passage in which at least two axle supporting legs are attached to and extend downwardly from the wheel assembly panel. It is shown without an axle.
Figure 11:
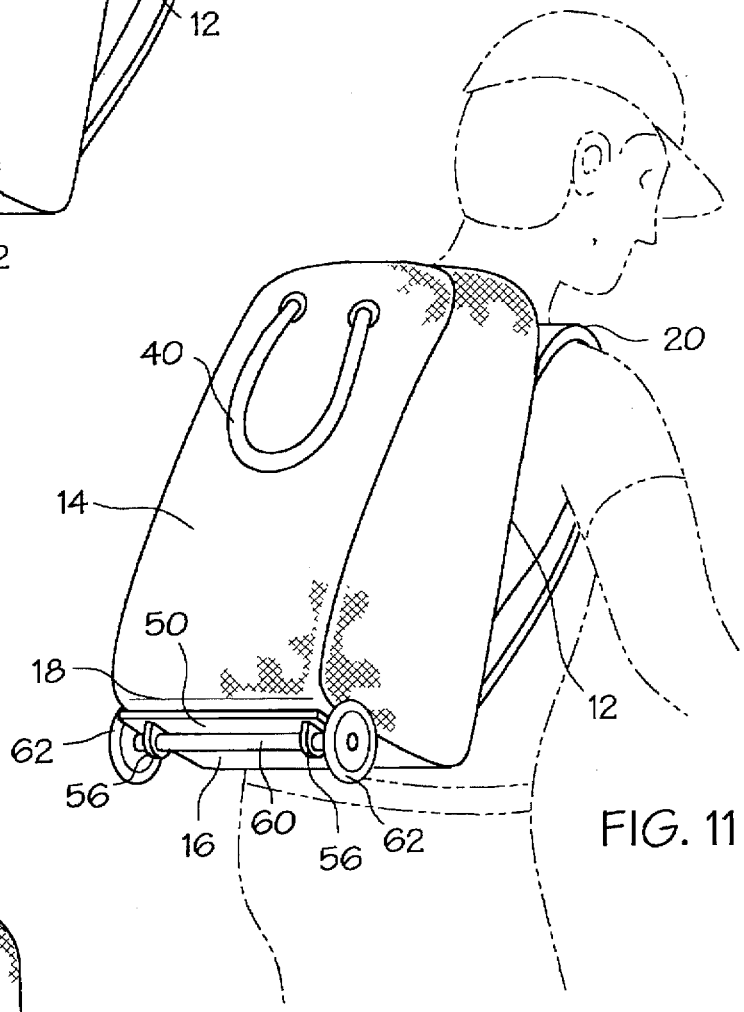
FIG. 11 is a perspective view of the wheeled knapsack shown in FIG. 10 with an axle in the axle passage as it is being carried on a user's back.
Figure 12:
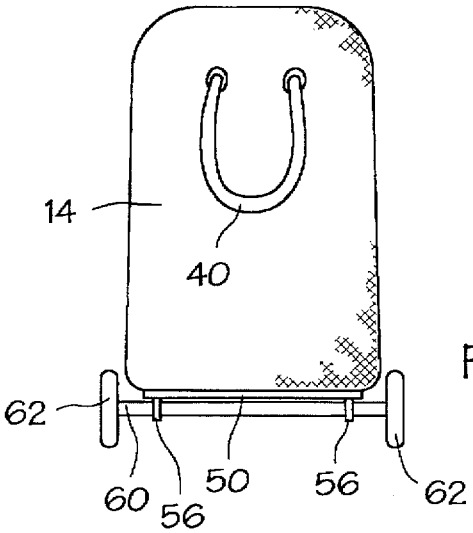
FIG. 12 is a rear elevational view of FIG. 11.

FIG. 10, 11, and 12 show another variation of the preferred embodiment, in which the axle 60 is supported by at least two axle supporting legs 56, each of which is attached to and extends downwardly from the wheel assembly panel 50 and has a hole forming an axle passage 52 for the axle 60 to pass therethrough. Each of two axle wheels 62 is attached to each end of the axle 60, supporting the wheeled knapsack 1, but not in contact with the bag portion 10, as shown in FIG. 12. The axle 60 and the axle wheels 62 turn as the wheeled knapsack is pulled by the user who grabs and pulls the pulling means 40, thereby causing the wheeled knapsack 1 to move on the flat surface of the ground or the walkway.

What is claimed is:

1. A wheeled knapsack comprising:

a bag portion having a body-contact side, a non-body-contact side, and a base section, said non-body-contact side and and said body-contact side facing each other, said non-body-contact side further forming with said base section a rear edge longitudinally across said base section;

a pair of shoulder straps provided on said body-contact side of said bag portion and adapted to be hung from a user's shoulders;

at least two wheels attached to said base section along said rear edge, each of said at least two wheels positioned apart from each other; and a pulling means attached to said non-body-contact side of said bag portion for pulling said wheeled knapsack on a flat surface in an inclined position with said non-body-contact side facing slightly downward and said body-contact side facing slightly upward such that said pair of shoulder straps avoid any contact with the flat surface as said wheeled knapsack is pulled on the flat surface.

2. A wheeled knapsack according to claim 1, wherein said pulling means is a U-shaped handle strap attached to said non-body-contact side of said bag portion.

3. A wheeled knapsack comprising:

a bag portion having a body-contact side, a non-body-contact side, and a base section, said non-body-contact side and said body-contact side facing each other without sharing any vertically common edges, said non-body-contact side further forming with said base section a rear edge longitudinally across said base section:

a pair of shoulder straps provided on said body-contact side of said bag portion and adapted to be hung from a users shoulders;

a wheel assembly panel longitudinally mounted on said base section near said rear edge;

at least two wheels attached to said wheel assembly panel parallel to said rear edge, each of said at least two wheels positioned apart from each other; and a pulling means attached to said non-body-contact side of said bag portion for pulling said wheeled knapsack on a flat surface in an inclined position with said non-body-contact side facing slightly downward and said body-contact-side facing slightly upward such that said pair of shoulder straps avoid any contact with the flat surface as said wheeled knapsack is pulled on the flat surface.

4. A wheeled knapsack according to claim 3, wherein said pulling means is a U-shaped handle strap attached to said non-body-contact side of said bag portion.

5. A wheeled knapsack comprising:

a bag portion having a body-contact side, a non-body-contact side, and a base section, said non-body-contact side and said body-contact side facing each other, said non-body-contact side further forming with said base section a rear edge longitudinally across said base section:

a pair of shoulder straps provided on said body-contact side of said bag portion and adapted to be hung from a user's shoulders;

an axle supporting means longitudinally mounted on said base section near said rear edge, said axle supporting means having an axle passage;

an axle placed within said axle passage and having two wheels, each of which is attached to each end of said axle; and a pulling means attached to said non-body-contact side of said bag portion for pulling said wheeled knapsack on a flat surface in an inclined position with said non-body-contact side facing slightly downward and said body-contact side facing slightly upward such that said pair of shoulder straps avoid any contact with the flat surface as said wheeled knapsack is pulled on the flat surface.

6. A wheeled knapsack according to claim 5, wherein said pulling means is a U-shaped handle strap attached to said non-body-contact side of said bag portion.

7. A wheeled knapsack as claimed in 5, wherein said axle supporting means includes an wheel axle panel longitudinally mounted on said base section near said rear edge, said wheel axle panel further having said axle passage that is formed by a longitudinal bore extending through said wheel axle panel.

8. A wheeled knapsack according to claim 7, wherein said pulling means is a U-shaped strap attached to said non-body-contact side of said bag portion.

9. A wheeled knapsack as claimed in 5, wherein said axle supporting means includes said wheel assembly panel longitudinally mounted on said base section near said rear and at least two axle supporting legs, each of said axle supporting legs is attached to said wheel assembly panel spaced from each other and extends downwardly from said wheel assembly panel, each of said axle supporting legs further having a hole to form said axle passage for accommodating said axle.

10. A wheeled knapsack according to claim 9, wherein said pulling means is a U-shaped handle strap attached to said non-body-contact side of said bag portion.

* * * * *